US005743460A

United States Patent [19]

Capy et al.

[11] Patent Number: 5,743,460

[45] Date of Patent: Apr. 28, 1998

[54] PLEATED PAPER WRAPPER FOR ELONGATE OBJECTS

[76] Inventors: Gilbert Capy, La Botte 69640, Jarnioux, France; Akiva Buchberg, 5030 Pine Tree Dr., Miami Beach, Fla. 33140

[21] Appl. No.: 676,197

[22] PCT Filed: Feb. 10, 1995

[86] PCT No.: PCT/FR95/00157

§ 371 Date: Jul. 17, 1996

§ 102(e) Date: Jul. 17, 1996

[87] PCT Pub. No.: WO95/21778

PCT Pub. Date: Aug. 17, 1995

[30] Foreign Application Priority Data

Feb. 11, 1994 [FR] France ..... 94 01785

[51] Int. Cl.[6] ..... B65D 65/12

[52] U.S. Cl. ..... 229/87.03; 383/120

[58] Field of Search ..... 383/120, 2; 229/87.03

[56] References Cited

U.S. PATENT DOCUMENTS

| | | | |
|---|---|---|---|
| 1,505,012 | 8/1924 | Distefano | 383/120 X |
| 1,555,115 | 9/1925 | Hand | 383/120 X |
| 1,846,949 | 2/1932 | Clark | 383/120 X |
| 1,948,615 | 2/1934 | Clark | 383/120 X |
| 3,078,895 | 2/1963 | Silver | 383/120 X |
| 3,834,528 | 9/1974 | Pickford et al. | 383/120 X |
| 3,987,959 | 10/1976 | Dearols et al. | 383/120 X |
| 4,795,648 | 1/1989 | Capy et al. | 383/120 X |
| 4,892,744 | 1/1990 | Ylvisaker | 383/120 X |
| 4,946,290 | 8/1990 | Matyja | 383/120 X |
| 5,125,564 | 6/1992 | Capy | 383/120 X |
| 5,518,167 | 5/1996 | Capy et al. | 383/120 X |
| 5,590,783 | 1/1997 | Capy et al. | 229/87.03 X |

FOREIGN PATENT DOCUMENTS

| | | | |
|---|---|---|---|
| 9203345 | 3/1992 | WIPO | 383/120 |
| 9319996 | 10/1993 | WIPO | 383/120 |

*Primary Examiner*—Jes F. Pascua

*Attorney, Agent, or Firm*—Kane, Dalsimer, Sullivan, Kurucz, Levy, Eisele and Richard, LLP

[57] ABSTRACT

The wrapper primarily consists of a flexible thin film bag comprising two faces pleated parallel to the base, the pleats being secured to one another at their ends corresponding to the lateral edges of the bag. The opening of the bag is extended on the side of face by a flap. The opening of the bag is widened by partially unfolding the pleats of faces to form a container enclosing the object to be wrapped. The flap covers the object to be wrapped and its end is wedged between face and the object to be wrapped; then the user only has to pull on the ends, to partially reform the pleats about the object to be wrapped. The bag is useful as a wrapper for enclosing elongated objects such as long sandwiches.

5 Claims, 3 Drawing Sheets

PLEATED PAPER WRAPPER FOR ELONGATE OBJECTS

BACKGROUND OF THE INVENTION

1. Field of the Invention

The invention relates to a pleated paper wrapper for long sandwiches.

2. Description of the Prior Art

There are two principal ways of wrapping long sandwiches with paper, namely, firstly, a single, flat piece of paper which is rolled around the long sandwich and, secondly, a long, narrow paper bag into which the sandwich is slipped lengthways. The first solution uses up a great deal of paper and it is necessary to unwrap the sandwich completely in order to be able to eat it, whilst the second solution is not very practical in use because the sandwich has to be inserted in the way a sock is slipped on. However, pleated paper wrappers for round sandwiches have been developed and these are described in patents FR-A-2,595,666 and FR-A-2,676,037, as have bulk product wrappers, also made from pleated paper, and these are described in patents FR-A-2,689,105 and FR-A-2,692,867, but none of these wrappers has been able to solve the problem of wrapping long sandwiches in a practical and elegant manner. Moreover, users of pleated wrappers are seeking uniformity in their range of wrappers.

SUMMARY OF THE INVENTION

The object of the present invention is to describe a wrapper, for long sandwiches, which is economical, made from paper, practical to use in kitchens, practical for the consumer and, finally, which looks good.

BRIEF DESCRIPTION OF THE DRAWINGS

The invention is described hereinafter with the aid of an example and references to the appended drawings, in which.

DESCRIPTION OF THE PREFERRED EMBODIMENTS

Figure 1:
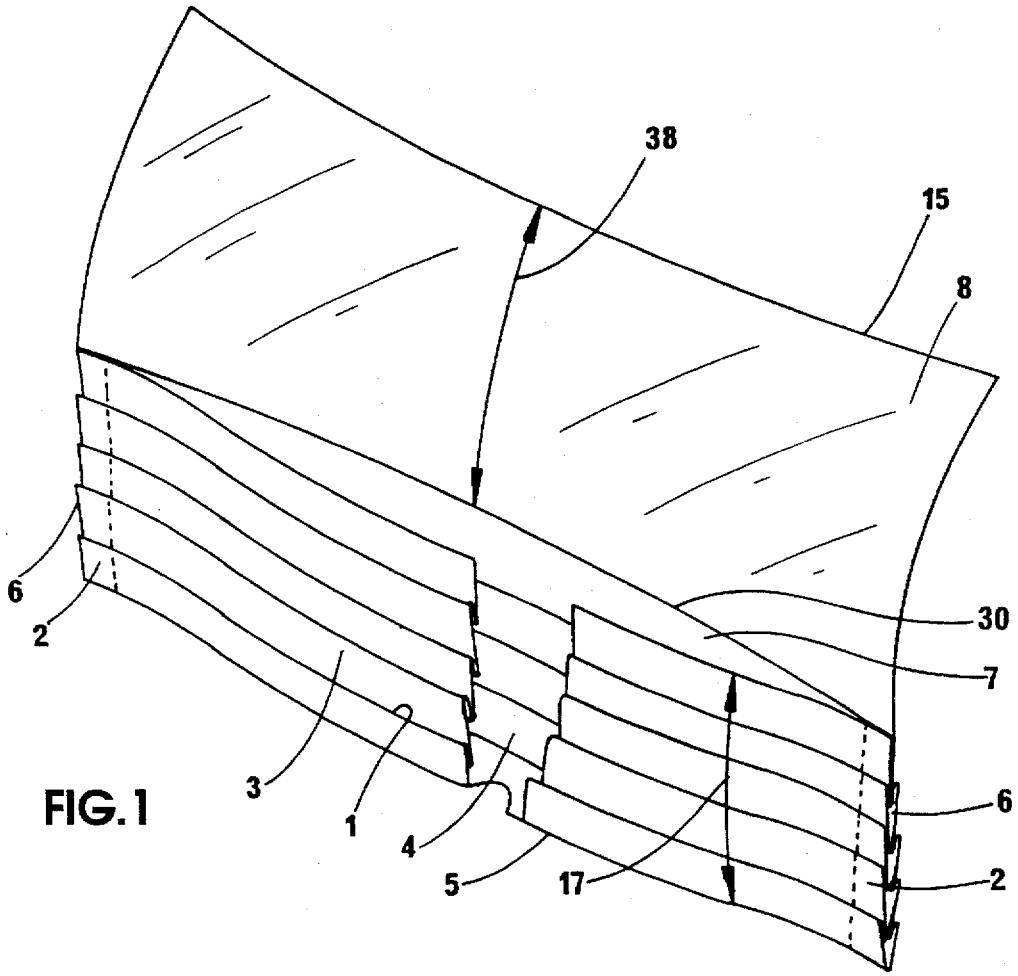
FIG. 1 shows the wrapper according to the invention before use; a cutout has been made to show the shape of the pleats in the body of the bag.

As illustrated in FIG. 1, the invention consists in making an elongate rectangular bag formed from a flexible thin film which has been previously pleated into flat pleats 1 which are secured at their ends 2 and free between these ends and which is folded over on itself parallel to the direction of the pleats 1. The bag comprises two pleated walls 3 and 4 connected together by a pleat 5 forming the base of the bag which is parallel to the pleats 1 of the thin film constituting the walls 3 and 4. The lateral edges 6 corresponding to the end 2 of the pleats 1 run from the base pleat 5 as far as the opening 7 and are secured together by any available existing means. One of the walls 4 of the bag is extended along its border 30 by a flap 8 of generally rectangular shape. This flap 8 may consist of the pleated continuation of the pleated wall 4 or consist of a non-pleated part 10 (FIG. 5) of the film constituting the wrapper or of an attached planar sheet 9 (FIG. 6). In the preferred variant of the invention, the width 38 of the flap 8 is of the order of twice the height 17 of the bag.

Figure 3:
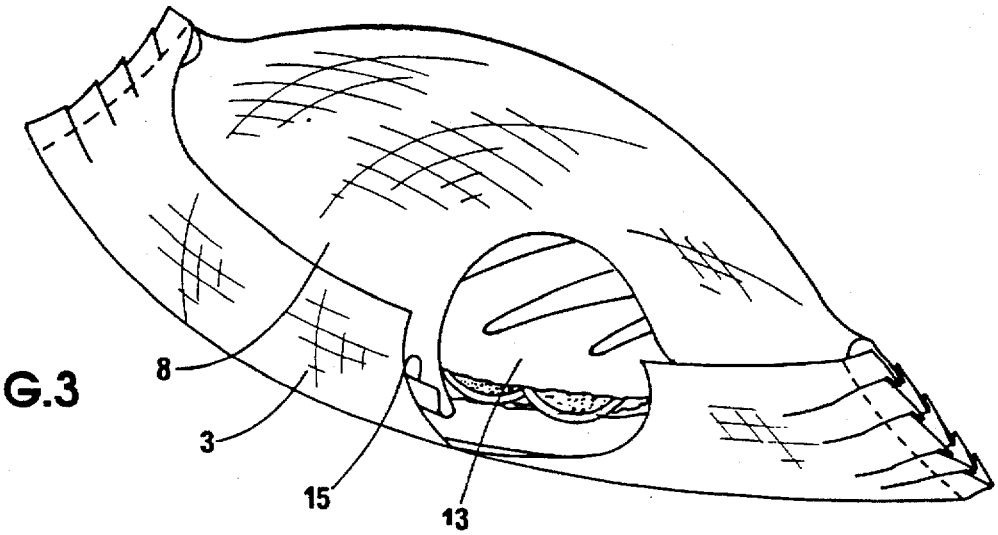
FIG. 3 shows the same wrapper containing a long sandwich which has been covered by the flap; a cutout shows the position of the flap with respect to the body and the sandwich.
Figure 2:
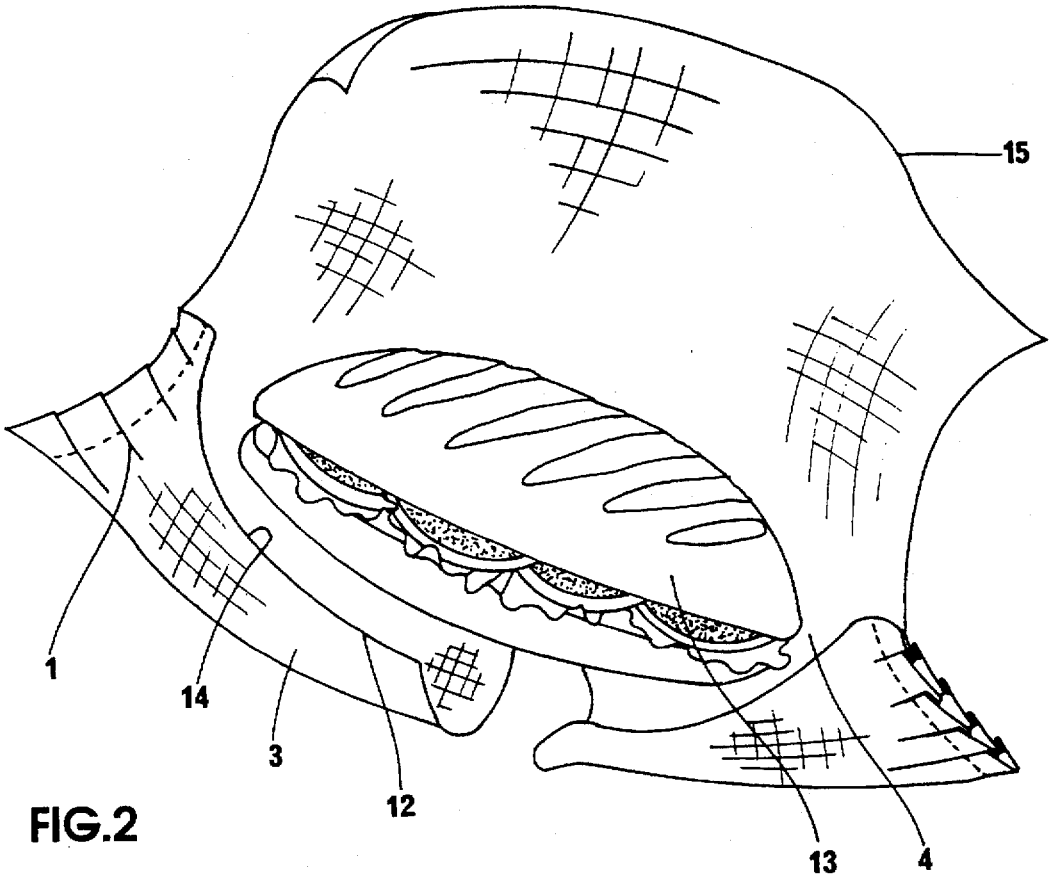
FIG. 2 shows the same wrapper whose pleats have been separated in the part forming the body for the insertion of a long sandwich therein; a cutout has been made to show that the pleats have been unfolded.
Figure 4:
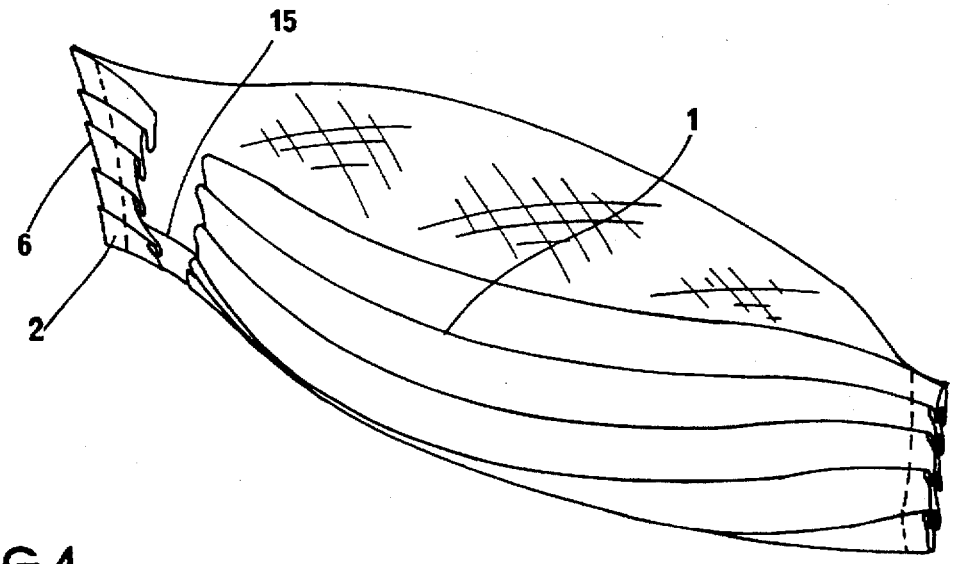
FIG. 4 shows the same wrapper whose pleats have been partially re-formed to match the shape of the long sandwich it contains as far as possible; a cutout shows that the pleats have been re-formed.

The use of such a bag (FIG. 2) consists in opening it wide by separating the edge 12 from the edge 30 and by partially unfolding the pleats 1 of the walls 3 and 4 of the bag so as to make a container 14. The long sandwich 13 is then placed inside the container 14 so that it is substantially parallel to the direction of the pleats 1, the sandwich 13 is covered (FIG. 3) with the flap 8 and its end 15 is wedged between the sandwich 13 and the opposite wall 3. Finally, the sides 6 (FIG. 4) of the bag, corresponding to the end 2 of the pleats 1, are pulled to partially re-form the pleats around the sandwich and to lock the flap 15 in its closed position.

Figure 5:
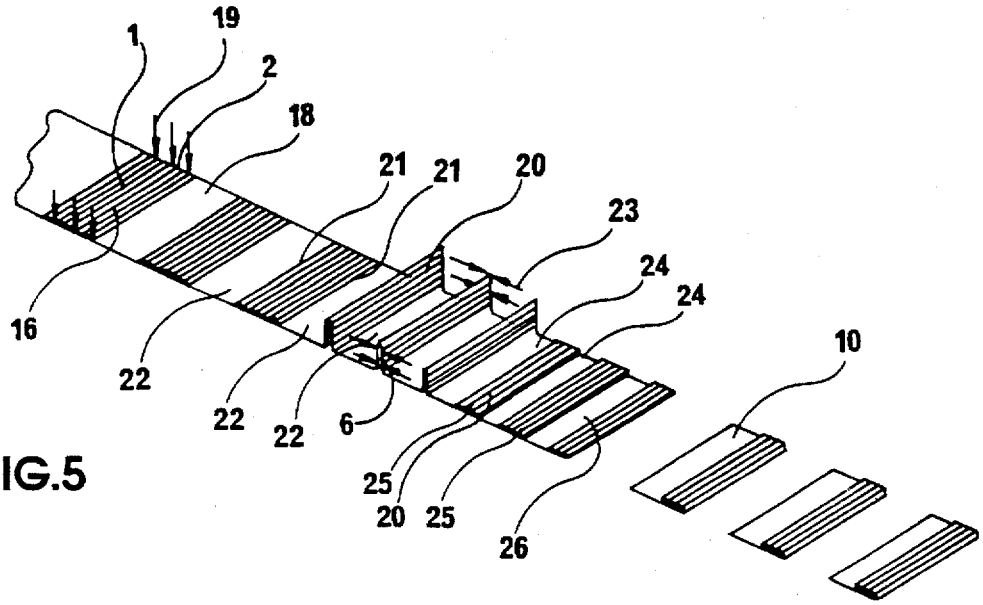
FIG. 5 shows an embodiment of this wrapper made from a single film.
Figure 6:
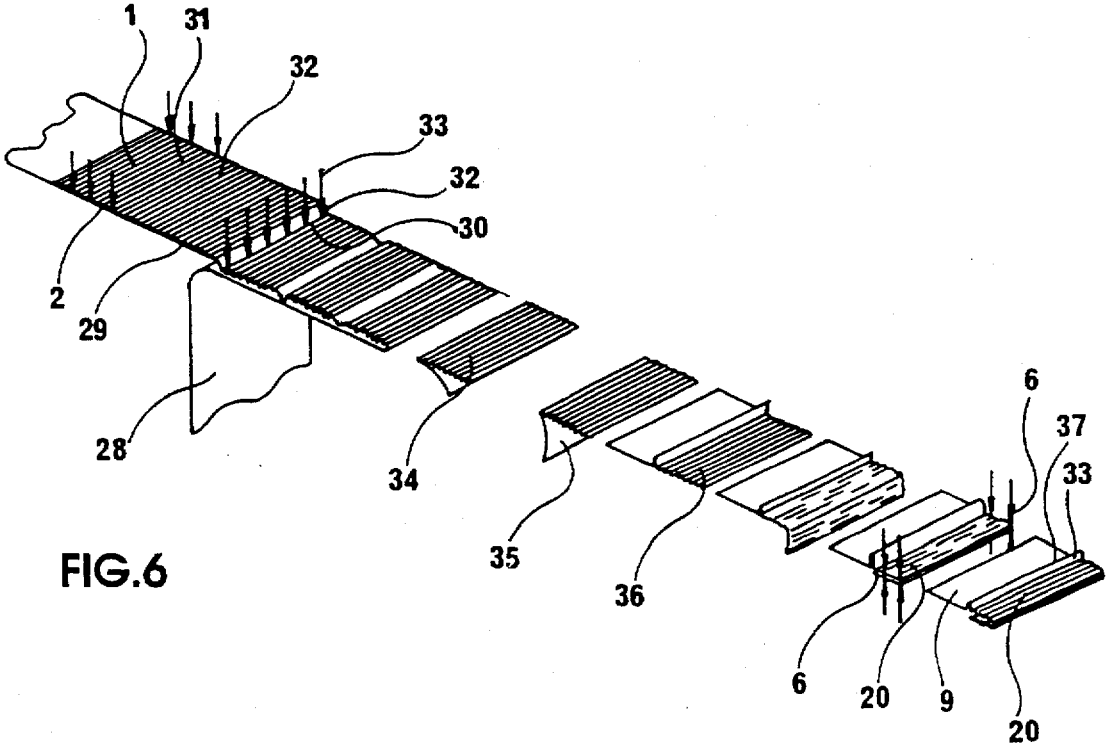
FIG. 6 shows the making of this wrapper from two films.

As shown in FIG. 5, one way of making such a bag comprising, for example, a non-pleated flap 10, consists, using a reel of a material such as paper coated with polyethylene on one face, having the width of the bag to be made, in making a zone 16 which is pleated transversely to the direction of the reel over a length equal to twice the height 17 (FIG. 1) of the bag, excluding flap 8, then of making a zone 18 without pleats with a width which is preferably of the same order of magnitude as the width of the pleated zone 16. The ends 2 of the pleats 1 are then secured laterally by welding 19 the polyethylene-covered faces which are opposite one another. The pleated part 16 is then folded in two to form the body 20 of the bag, its ends 21 being brought against one another so that the polyethylene-covered faces are inside and so that two consecutive zones 22 without pleats lie beside one another. The lateral edges 6 are then secured by welding 23 the polyethylene-covered faces together along two lateral strips. The body 20 of the bag thus formed is then folded down onto one of the two zones 24 without pleats which border it so that the pleated zones 25 are all in the same direction. A continuous strip in which bodies 20 of pleated bags follow on from one another, connected together by a visible strip of the zone 24 of non-pleated paper is thus obtained. Given that each non-pleated space 24 is wider than the height 17 (FIG. 1) of the body 20 (FIG. 5) of the bag, when flat each bag reveals, between itself and the bag following it or preceding it, a space 26 comprising only one thickness of non-pleated paper. It is in this space 26 that it is easy to make the cut which separates the finished wrappers 27 from one another.

In a variant of the invention, the non-pleated part 8 (FIG. 1) is an attached sheet with a width 38 equivalent to that of the sum of the widths 17 of the pleated parts 3 and 4 and is secured to one of the edges 30 of the opening 7 of the bag. One way of making this wrapper consists in manufacturing, from a reel formed, for example, from paper coated with polyethylene on one face, a pleated part 31 (FIG. 6) formed from pleated zones 29 separated from narrow zones 32 without pleats and in laterally securing the end 2 of the pleats 1 thereof as previously. A strip 28 which is preferably of the same width as the width of the pleated part, but which may also be different if this proves necessary, is attached and secured transversely by means of a weld 33 at the zone 32 without pleats. The assemblies 34 thus formed are separated and the flat part 35 is turned over so that the pleated part 36 can be folded over on itself in the direction previously indicated and the edges 6 thereof are secured by welding so as to obtain a finished wrapper 37.

This type of wrapper, which has been described for long sandwiches, may also be used for a whole variety of articles capable of being held in the cavity 14, including round or elongate articles such as oranges or bananas. In the case of wrapping round articles, it may be advantageous to replace the planar part 8 with a part which is pleated transversely, parallel to the pleats of the bag, whose pleats are secured at their ends. This pleating operation makes it possible to match the shape of the round article as far as possible.

We claim:

1. A wrapper for an article to be wrapped made from a pleated, flexible, thin film, the wrapper comprising a base, a front, substantially rectangular face and rear substantially rectangular face each having a top having edges, and having opposed lateral sides and pleats on the faces, the pleats having opposed ends corresponding to the opposed sides and being secured at the ends, the wrapper forming a rectangular bag having an opening defined by the edges of the top of the faces, a flap having a free end made from a flat, thin film which extends from one of the edges of the rectangular faces, the base having a pleat, the faces being connected together by the pleat of the base which is parallel to the pleats on the faces, the lateral sides being secured together at the ends of the pleats and the rear face being extended, on the bag opening, by the flap whereby the article to be wrapped is wrapped by initially separating the opening by pulling the edges widely apart, partially unfolding the pleats of the faces so as to make the bag of a size which is sufficient for the article to be wrapped to be placed therein, placing the article to be wrapped in the bag, covering the article with the flap, wedging the free end of the flap between the article to be wrapped and the front face, and, finally, the sides of the wrapper corresponding to the ends of the pleats are pulled so as to partially re-form the pleats around the article and to lock the flap in its closed position.

2. The wrapper according to claim 1, characterized in that the film of the wrapper is heat-sealable on one surface.

3. The wrapper according to claim 1, characterized in that the flap is made of the same film as the rear face.

4. The wrapper according to claim 1, characterized in that the flap is made from flexible, thin unpleated film attached to the rear face.

5. Wrapping method comprising initially providing a wrapper, for an article to be wrapped made from a pleated, flexible, thin film, the wrapper comprising a base, a front, substantially rectangular face and rear, substantially rectangular face, the faces having top edges and having opposed lateral sides and pleats on the faces, the pleats having opposed ends corresponding to the opposed sides and being secured at the ends, the wrapper forming a rectangular bag having an opening, a flap having a free end made from a flat, thin film which extends from one of the edges of the rectangular faces, the base having a pleat, the faces being connected together by the pleat of the base which is parallel to the pleats on the faces, lateral sides being secured together at the ends of the pleats and the rear face being extended, on the bag opening side, by the flap, separating the opening by pulling the edges widely apart, partially unfolding the pleats of the faces so as to make the bag of a size which is sufficient for the article to be wrapped to be placed therein placing the article to be wrapped in the bag, covering the article with the flap, wedging the free end of the flap between the article to be wrapped and the front face, and, finally, the sides of the wrapper corresponding to the ends of the pleats are pulled so as to partially re-form the pleats around the article and to lock the flap in its closed position.

* * * * *